US006047502A

United States Patent [19]

Kimmitt et al.

[11] Patent Number: 6,047,502

[45] Date of Patent: Apr. 11, 2000

[54] RETROFIT GUTTER GUARD

[76] Inventors: Thomas J. Kimmitt, 2335 Marriottsville Rd., Marriottsville, Md. 21104; Louis Toth, 3220 Regents Row, West Friendship, Md. 21794; Clark K. Smith, 1004 Wedgewood La., Durham, N.C. 27713

[21] Appl. No.: 08/882,817

[22] Filed: Jun. 26, 1997

Related U.S. Application Data

[60] Provisional application No. 60/020,637, Jun. 27, 1996.

[51] Int. Cl.[7] ..... E04D 13/06

[52] U.S. Cl. ..... 52/12; 52/11; 52/16; 52/302.1

[58] Field of Search ..... 52/11, 12, 16, 52/302.1; 248/48.1

[56] References Cited

U.S. PATENT DOCUMENTS

| | | | |
|---|---|---|---|
| 2,669,950 | 2/1954 | Bartholomew | 52/12 |
| 3,826,048 | 7/1974 | Merkin et al. | 52/11 |
| 4,745,710 | 5/1988 | Davis | 52/12 |
| 5,056,276 | 10/1991 | Nielsen | 52/12 |
| 5,234,582 | 8/1993 | Savoie | 210/163 |
| 5,251,410 | 10/1993 | Carey | 52/12 |
| 5,305,562 | 4/1994 | Sapia | 52/12 |
| 5,339,575 | 8/1994 | Kuhns | 52/12 |
| 5,398,464 | 3/1995 | Jacobs | 52/12 |
| 5,459,965 | 10/1995 | Meckstroth | 52/12 |
| 5,555,680 | 9/1996 | Sweers | 52/12 |
| 5,611,175 | 3/1997 | Sweer | 52/12 |
| 5,640,809 | 6/1997 | Iannelli | 52/12 |

*Primary Examiner*—Carl D. Friedman
*Assistant Examiner*—Phi Dieu Tran A
*Attorney, Agent, or Firm*—Law Offices of Royal W. Craig

[57] ABSTRACT

An improved gutter guard that operates by capillary action to allow water to flow off the roof and into an existing gutter system, yet precludes foreign matter from entering into the gutter, thereby preventing the gutter from becoming clogged, and providing a substantially maintenance-free gutter system. Preferred embodiments are shown for both plastic and aluminum construction, and several attachment means are shown for anchoring the gutter guard to a standard gutter system. The gutter guard can be economically manufactured and easily retrofit or used in conjunction with existing gutters.

25 Claims, 6 Drawing Sheets

RETROFIT GUTTER GUARD

CROSS-REFERENCE TO RELATED APPLICATIONS

The present application claims priority from U.S. Provisional Application Serial No. 60/020,637, filed Jun. 27, 1996, by Kimmett et al. for their "Retrofit Gutter Guard".

BACKGROUND OF THE INVENTION

1. Field of the Invention

The present invention relates to guards to prevent clogging of gutters and, more particularly, to an inherently low-cost, durable and retrofit gutter guard that drains off the rain water by capillary action, such that leaves, twigs or foreign matter will not enter into and clog the gutter.

2. Description of the Background

Gutters which are currently available on the market, and which are widely used by the homeowner, must be cleaned periodically. The cleaning should occur at least once a year to remove foreign matter from the gutters and, if the house is located on a wooded lot, several times a year as necessary. The foreign matter commonly includes leaves, twigs, acorns, insects, vermin, bird nests, and even pieces of deteriorating roof shingles. However, cleaning such gutters is a time-consuming and laborious task. It can also be quite dangerous, depending upon the height and pitch of the roof.

There have been many previous efforts to develop gutters or guards therefor which prevent clogging and eliminate the need to periodically clean. For instance, wire screens or meshes are commonly wedged or otherwise fitted within the gutters and across the top thereof so as to filter out the foreign matter from entering into the gutter. However, these wire screens also become clogged and are easily dislodged and damaged. Additionally, the openings within the screens are relatively large to collect the water flowing off the roof. Therefore, the screens are not completely satisfactory.

U.S. Pat. No. 4,667,448 issued to Smith shows a gutter system and a method of manufacture thereof that allows water to flow off the roof and into the gutter by capillary action, yet precludes foreign matter from entering into the gutter, thereby preventing the gutter from becoming clogged, and providing a substantially maintenance-free gutter system for the eves of a home or other structure. Although the gutter is relatively easy to install, durable, and is substantially maintenance free, it is a stand-alone gutter system and cannot be retrofit or used in conjunction with existing gutters. It is not economically practical in all situations to completely replace an existing gutter system.

It would be greatly advantageous to provide a capillary-flow gutter guard with the benefits described above and which can be applied as a retrofit guard to an existing gutter system.

SUMMARY OF THE INVENTION

It is, therefore, an object of the present invention to provide an improved gutter guard which allows water to flow off the roof and into the gutter by capillary action, yet precludes foreign matter from entering into the gutter, thereby preventing the gutter from becoming clogged, and providing a substantially maintenance-free gutter system.

It is another object to provide a gutter guard with the above-described advantages and which can be retrofit or used in conjunction with existing gutters.

It is another object to provide a clip for securing the retrofit gutter guard of the present invention to an existing gutter.

According to the present invention, the above-described and other objects are accomplished by providing an improved gutter guard that operates by capillary action to allow water to flow off the roof and into an existing gutter system, yet precludes foreign matter from entering into the gutter, thereby preventing the gutter from becoming clogged, and providing a substantially maintenance-free gutter system. The gutter guard can be retrofit or used in conjunction with existing gutters. The gutter guard generally comprises an overhead section that is substantially planar and designed for insertion under the shingles on the sloping roof. The overhead section runs downward off the roof and spans the conduit before it joins a vertical section. The vertical section is defined by a plurality of substantially vertically-oriented cavities or apertures at tightly spaced and uniform intervals forming downward channels through the vertical section. The channels or apertures take advantage of this capillary action of water to divert rain water into the conduit. With the above-described arrangement, rain water will run off the roof and down the overhead section, and foreign matter will wash off the roof, thereby preventing the conduit from becoming clogged. A clip is also provided for securing the retrofit gutter guard of the present invention to an existing gutter.

BRIEF DESCRIPTION OF THE DRAWINGS

Other objects, features, and advantages of the present invention will become more apparent from the following detailed description of the preferred embodiment and certain modifications thereof when taken together with the accompanying drawings in which.

DETAILED DESCRIPTION OF THE PREFERRED EMBODIMENTS

Figure 1:
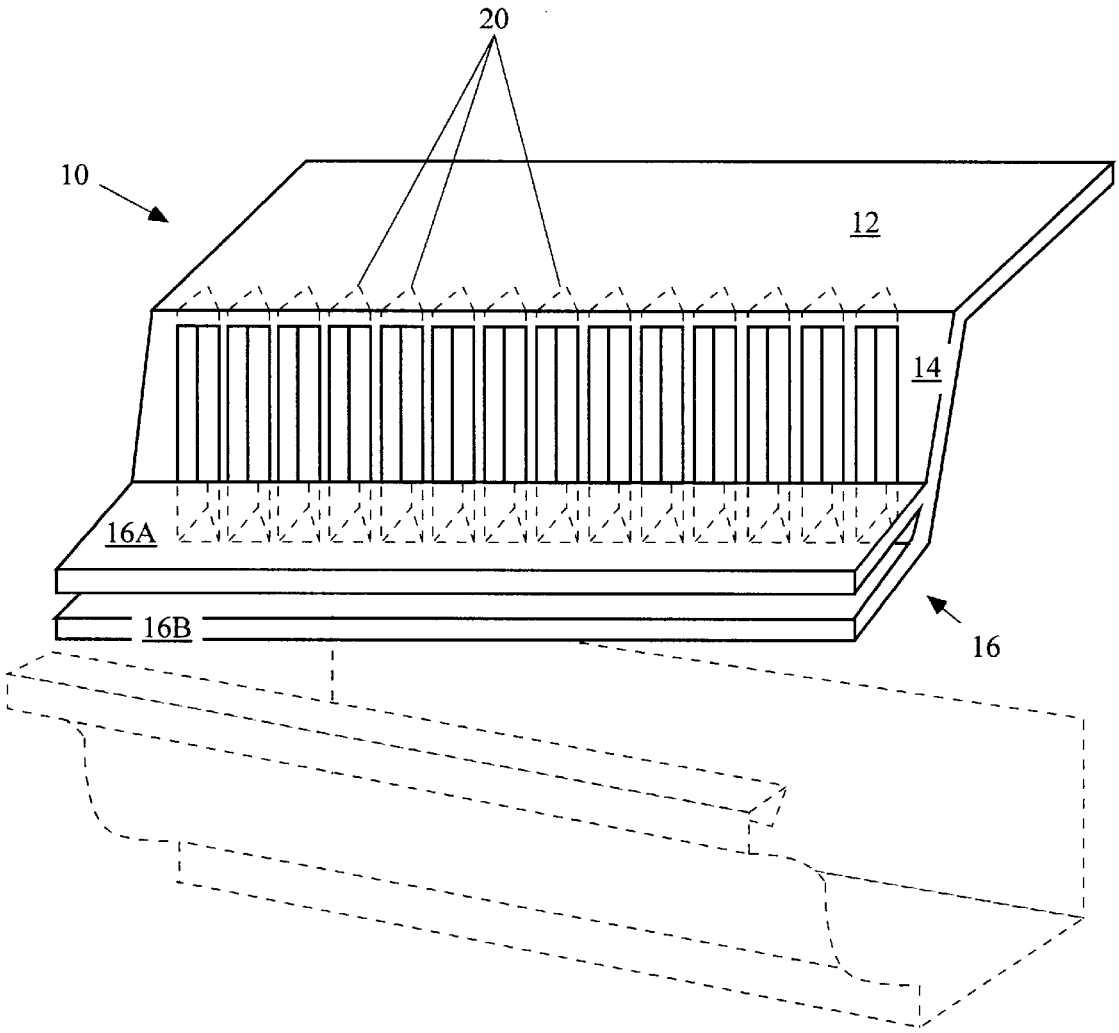
FIG. 1 is a perspective drawing illustrating a first embodiment of the gutter guard 10 according to the present invention.

FIG. 1 is a perspective drawing illustrating a first embodiment of the gutter guard 10 according to the present invention. The gutter guard 10 is designed to be retrofit onto a conventional gutter system over a standard conduit (shown in dotted lines). Such conduits generally include a bottom wall and integral front and back walls formed to define a trough. In cross-section, the conduit may be of any conventional configuration such as square, "rectangular, oval, circular or the like. The conduit may be supported on a bracket which is secured to a support plate or fascia of the roof structure by conventional means.

The gutter guard 10 shown in FIG. 1 is preferably molded as an integral unit from plastic, vinyl, aluminum, or any other suitable weather resistant composite or material. Gutter guard 10 is formed in any length in accordance with the length of the conduit to which it will be fitted (FIG. 1 shows a short section of gutter guard 10 for illustrative purposes). Gutter guard 10 is integrally molded with three planar sections including: 1) an overhead section 12 which is angled downward slightly; 2) a vertical section 14 defined by a plurality of substantially vertically-oriented cavities 20 forming downward channels through the vertical section 14; and 3) a forward section 16 for anchoring the gutter guard 10 to the forward lip of the conduit. The overhead section 12 is substantially planar and designed for insertion under the shingles on the sloping roof. The overhead section 12 runs downward off the roof and spans the conduit before it joins the vertical section 14. The vertical section 14 adds a downward step and is preferably angled at about 90°±15° before it joins forward section 16. Vertical section 14 is defined by a plurality of substantially vertically-oriented elongate cavities 20 at tightly spaced and uniform intervals forming downward channels through the vertical section 14. As best seen in FIG. 1, each cavity comprises a vertically-extending, v-shaped cavity, such that the cavities form a series of v-shaped indentations extending into the face of vertical section 14. Each channel is thus defined by one of the v-shaped cavities. The wall of vertical section 14 as interrupted by cavities 20 appears to form a series of comb teeth. The vertical section runs downward into the forward section 16, which is a substantially horizontal flange designed for securing the gutter guard 10 to the lip of the front wall of the existing conduit.

Molecules of various liquids, such as water, have an inherent physical attraction not only for each other, but also for various surfaces along side of which and through which the water is directed. This molecular attraction is called capillary action. The present invention takes advantage of this capillary action of water to divert rain water into the conduit With the above-described arrangement, rain water will run off the roof and down the overhead section 12 of gutter guard 10, and will be drawn into the channels formed by cavities 20 by capillary action, while the debris and foreign matter will wash off the roof, thereby preventing the conduit from becoming clogged. As a result of the capillary action, the water literally does a right angle bend and flows into the cavities 20, which then divert the water behind the forward section 16 and into the conduit rather than washing off the roof and onto the adjacent ground along with the leaves, twigs and other debris.

Figure 2:
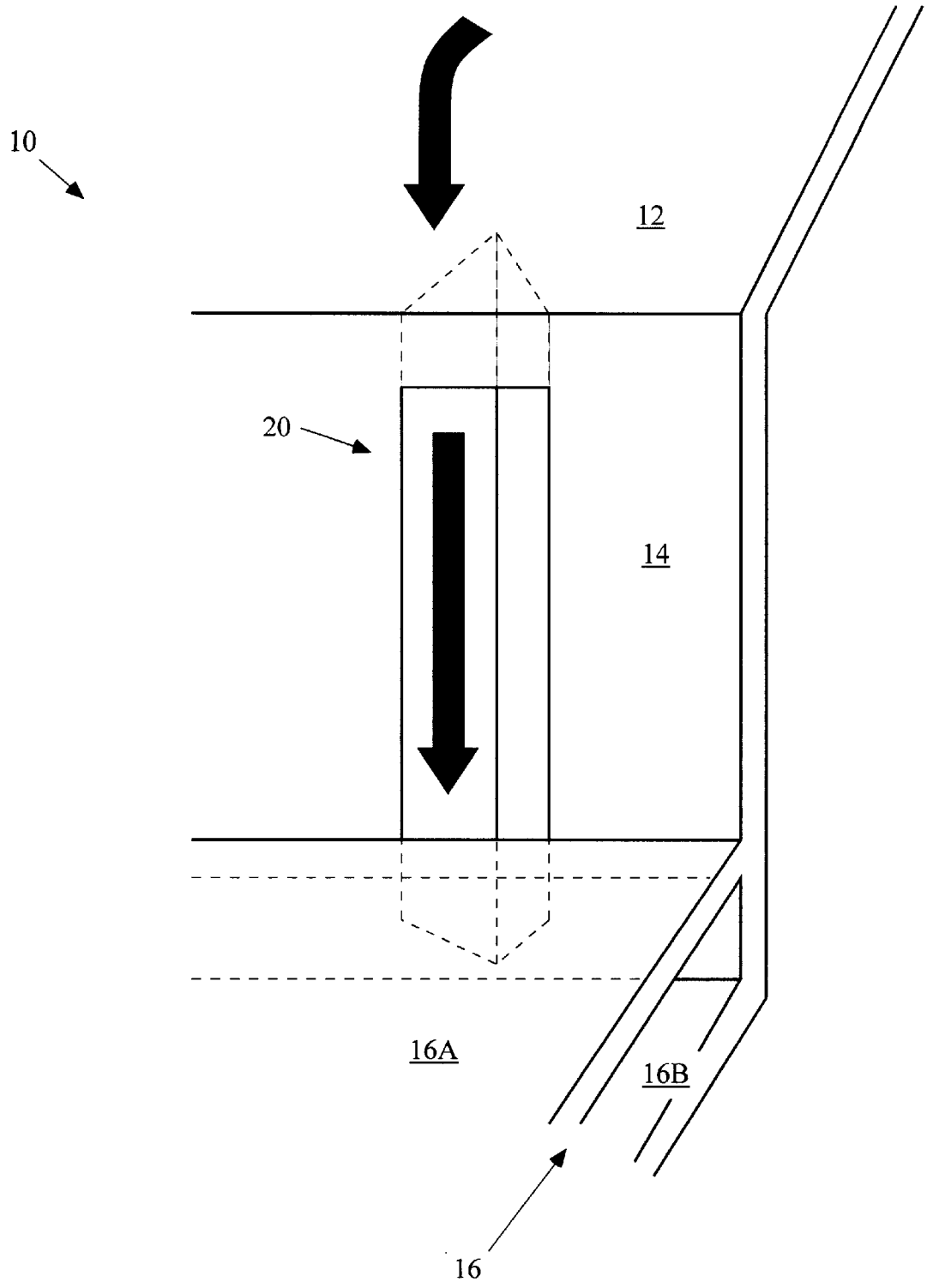
FIG. 2 is an enlarged perspective drawing illustrating the detail of a cavity 20 as formed in the vertical section 14 of FIG. 1.

FIG. 2 is an enlarged perspective drawing illustrating the detail of a cavity 20 as formed in the vertical section 14. To increase the load-bearing strength of the gutter guard 10, the structural juncture of overhead section 12 and vertical section 14 is not interrupted, i.e., each cavity 20 begins below the overhead section 12. The width of the cavity openings is preferably about ⅛", and this insures a proper capillary action while not overly complicating the mold. However, other cavity sizes may work as well. The cavities 20 are tightly spaced along the vertical section 14 at uniform intervals. It has been found that ⅛" intervals between the cavities work well, although other spacings may be suitable. The cavities 10 project downwardly the entire length of the vertical section 14 and empty downward into the conduit. The forward section 16 protrudes forwardly from the bottom of the vertical section 14 and is adapted to be clipped or otherwise joined to the forward lip of the conduit. For this purpose, the forward section 16 may comprise two opposing resilient flanges 16A and 16B which grip the lip of the conduit between themselves.

Figure 3:
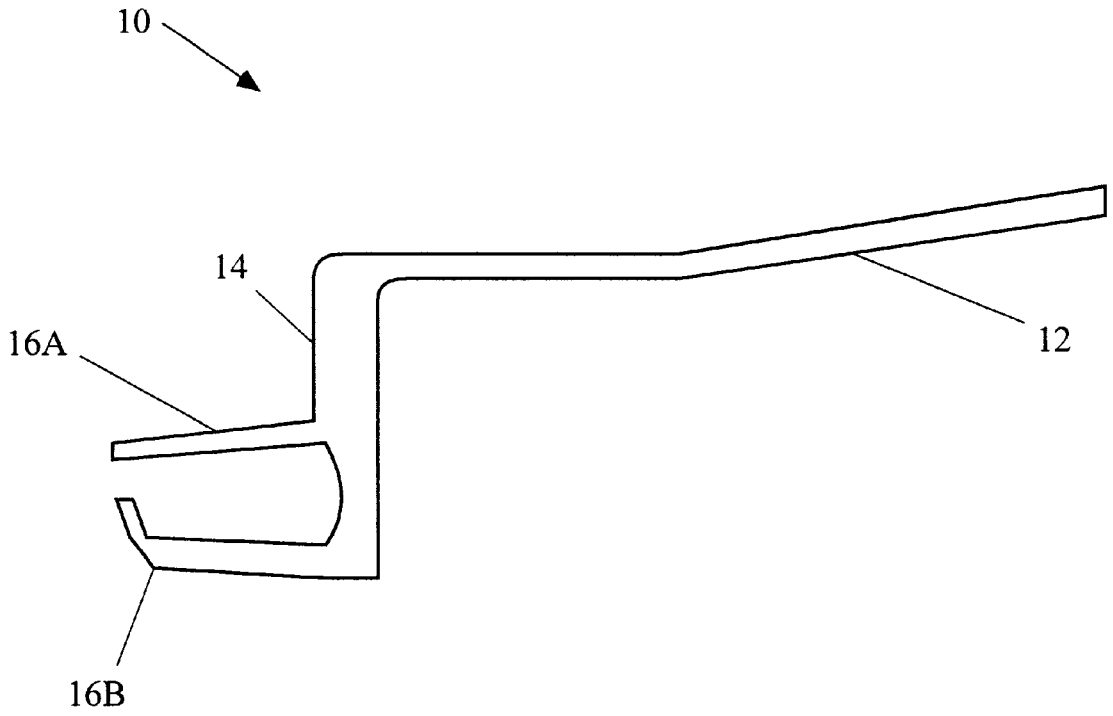
FIG. 3 is a side view of the gutter guard 10 that illustrates one means for anchoring the gutter guard 10 to the existing gutter system.

FIG. 3 is a side view of the gutter guard 10 that illustrates the two opposing resilient flanges 16A and 16B which grip the lip of the conduit between themselves, thereby anchoring the gutter guard 10 to the existing gutter system.

Figure 4:
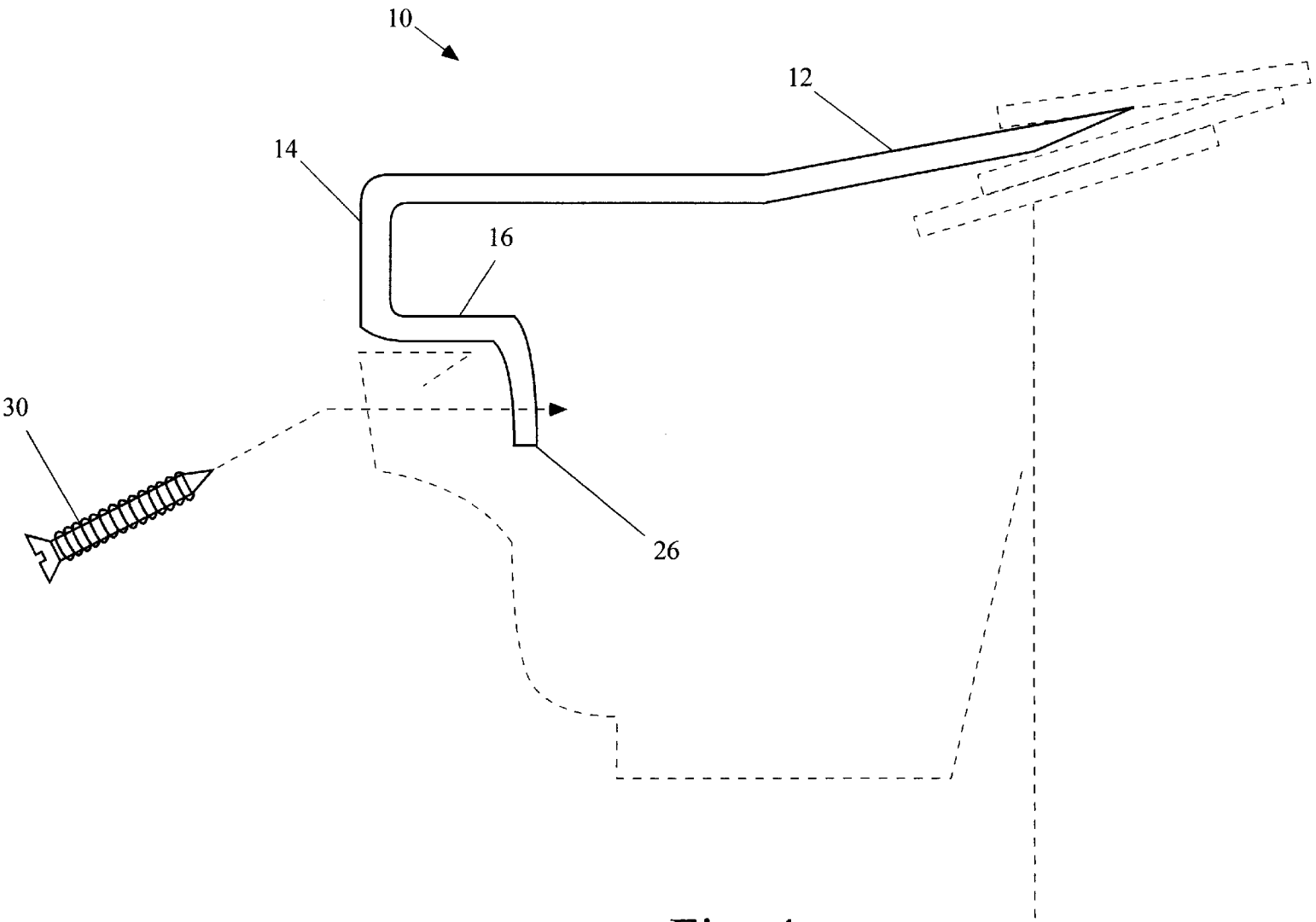
FIG. 4 is a side view of an alternative means for anchoring the gutter guard 10 to the existing gutter system.

FIG. 4 is a side view of an alternative means for anchoring the gutter guard 10 to the existing gutter system. In FIG. 4, the forward section 16 is formed as a forwardly projecting hood for fitting down behind the lip of the conduit. A conventional screw 30 can be screwed through the hooded forward section 16 and the lip of the gutter itself to anchor gutter guard 10 thereto. It should be noted that forward section 16 and downward protrusion 26 may be reflected about a 90 degree axis (so that protrusion 26 is seated in front of the gutter lip), and this will achieve the same advantages.

Figure 5:
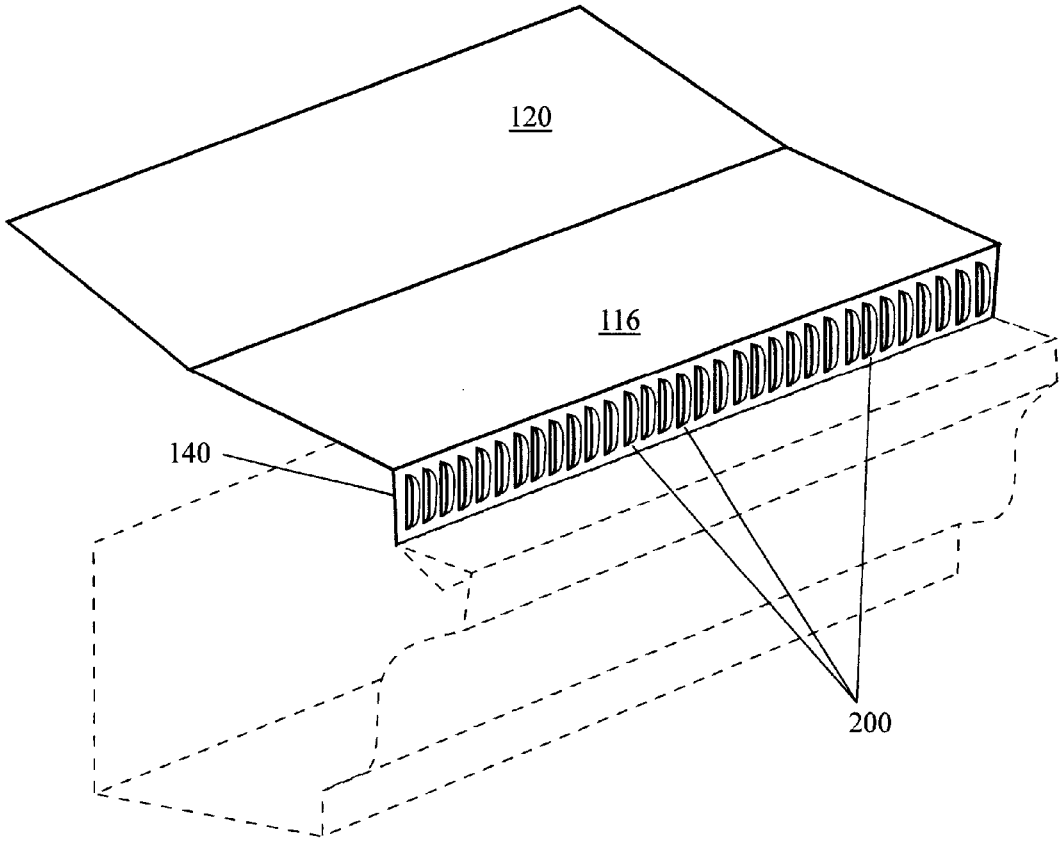
FIG. 5 is a perspective drawing illustrating a second embodiment of the gutter guard 100 according to the present invention.

FIG. 5 is a perspective drawing illustrating a second embodiment of the gutter guard 100 according to the present invention. The gutter guard 100 is preferably stamped from aluminum sheet into an integral unit. Gutter guard 100 is stamped in two planar sections including: 1) an overhead section 120 which is angled downward slightly; and 2) a vertical section 140 defined by a plurality of substantially vertically-oriented punched apertures 200 forming downward channels through the vertical section 140. The overhead section 120 is substantially planar and designed for insertion under the shingles on the sloping roof. The overhead section 120 runs downward off the roof and spans the conduit before it joins the vertical section 140. The vertical section 140 adds an abrupt 90° (±15°) downward step. The vertical section 140 may be clipped, screwed or otherwise joined to the forward lip of the conduit.

Vertical section 140 is stamped with a plurality of substantially vertically-oriented apertures 200 at tightly spaced and uniform intervals forming inward passages through the vertical section 140. The present embodiment again takes advantage of the capillary action of water to divert water into the conduit. With the above-described arrangement, rain water will run off the roof and down the overhead section 120 of gutter guard 100, and will be drawn into the perforations 200 by capillary action, while the debris and foreign matter will wash off the roof, thereby preventing the conduit from becoming clogged. As a result of the capillary action, the water literally does a right angle bend and flows into the perforations 200, which then divert the water behind the forward section 116 and into the conduit rather than washing off the roof and onto the adjacent ground along with the leaves, twigs and other debris.

Figure 6:
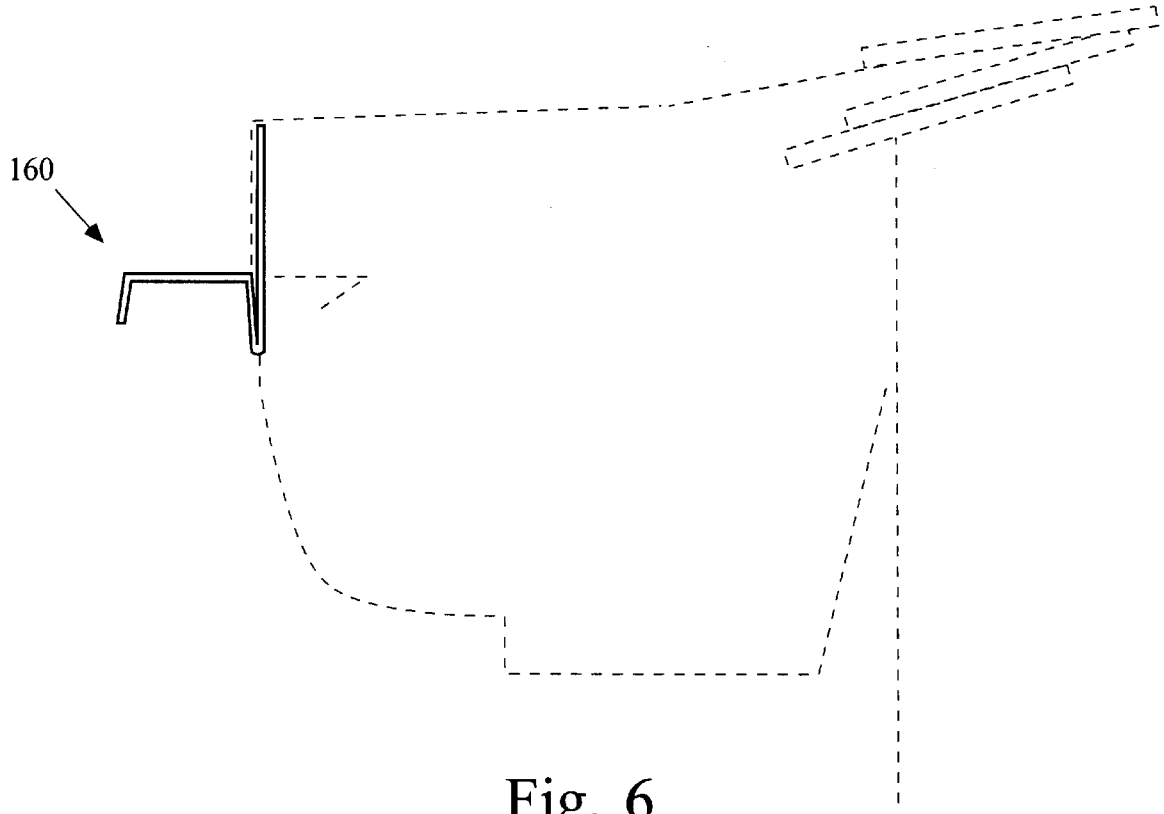
FIGS. 6–8 show a side view, an enlarged side view, and a front view, respectively, of the clip 160 used for securing the gutter guard 100 to the existing conduit.
Figure 7:
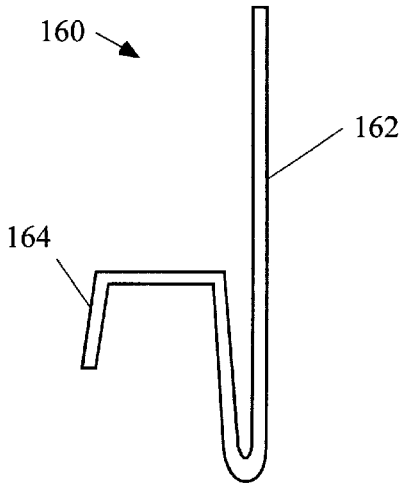
Figure 8:
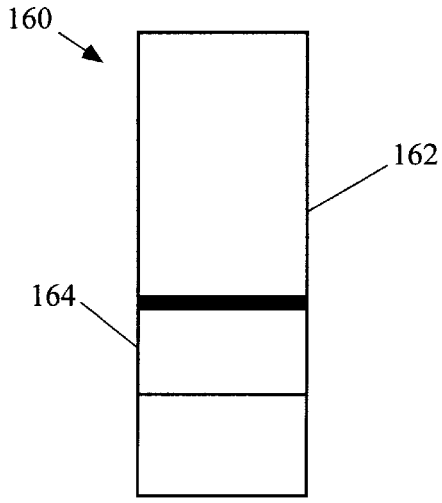

FIGS. 6–8 show a side perspective view, an enlarged side view, and a front view, respectively, of a clip 160 used for securing the gutter guard 100 to the existing conduit. Clip 160 is an angled aluminum or molded plastic strip formed with a rearward bracket 162 for insertion behind the vertical section 140. Rearward bracket 162 cradles and supports the gutter guard 100 via vertical section 140. Clip 160 also includes a forward loop 164 for gripping the forward lip of the conduit and seating the gutter guard 100 thereon. The clip 160 may be formed from an angled aluminum strip, and the angled configuration adds a necessary degree of resiliency to accommodate heat distortion and severe weather conditions.

Having now fully set forth the preferred embodiments and certain modifications of the concept underlying the present invention, various other embodiments as well as certain variations and modifications of the embodiments herein shown and described will obviously occur to those skilled in the art upon becoming familiar with said underlying concept. It is to be understood, therefore, that the invention may be practiced otherwise than as specifically set forth in the appended claims.

We claim:

1. A gutter guard for retrofit attachment to a conventional gutter system of the type formed with a trough, said gutter guard comprising a unitary overhead section adjoining a vertical section, which in turn adjoins a forward section for anchoring the gutter guard to the gutter system, said vertical section being defined by a plurality of vertically-oriented v-shaped cavities extending into a plane defined by said vertical section, and a plurality of vertically-extending channels, each said vertically-extending channel positioned within one of said vertically oriented v-shaped cavities, and each said vertically-extending channel positioned entirely within and running from top to bottom across a majority of said vertical section to form a vertically-oriented, narrow, elongate capillary channel, and providing ingress to the trough of said gutter system for drainage therein, whereby water running down said overhead section and onto said vertical section is drawn into the channels by capillary action and is directed into said gutter system, while debris and foreign matter wash off, said gutter guard thereby preventing the gutter system from becoming clogged.

2. The gutter guard for retrofit attachment to a conventional gutter system according to claim 1, wherein said overhead section is substantially planar for insertion under the shingles on a roof, and is angled slightly downward to said vertical section.

3. The gutter guard for retrofit attachment to a conventional gutter system according to claim 1, wherein said vertical section is oriented at approximately a 90° angle when attached to said gutter system.

4. The gutter guard for retrofit attachment to a conventional gutter system according to claim 1, wherein said cavities are tightly spaced at uniform intervals along said vertical section.

5. The gutter guard for retrofit attachment to a conventional gutter system according to claim 1, wherein said forward section is a substantially horizontal flange designed for securing the gutter guard to a lip of an existing gutter system.

6. The gutter guard for retrofit attachment to a conventional gutter system according to claim 1, wherein a juncture of said overhead section and vertical section is not interrupted by said vertically-extending channels, said vertically-extending channels being framed within said vertical section.

7. The gutter guard for retrofit attachment to a conventional gutter system according to claim 1, wherein said vertically-extending channels are approximately ⅛" wide to insure proper capillary action.

8. The gutter guard for retrofit attachment to a conventional gutter system according to claim 1, wherein said vertically-extending channels create downwardly running channels along said vertical section that empty rearwardly into the existing gutter system.

9. The gutter guard for retrofit attachment to a conventional gutter system according to claim 1, wherein said forward section further comprises a pair of opposing resilient horizontal flanges for gripping a lip of the existing gutter section, thereby anchoring the gutter guard.

10. The gutter guard for retrofit attachment to a conventional gutter system according to claim 1, wherein said forward section further comprises a forwardly projecting hood for fitting down over a lip of the existing gutter section.

11. The gutter guard for retrofit attachment to a conventional gutter system according to claim 10, further comprising a plurality of screws through the hooded forward section.

12. The gutter guard for retrofit attachment to a conventional gutter system according to claim 1, wherein said gutter guard is stamped from aluminum sheet into an integral unit with punched apertures in said vertical section.

13. The gutter guard for retrofit attachment to a conventional gutter system according to claim 1, further comprising a plurality of clips securing the forward section to the existing gutter system, said clips each being formed as an angled plastic strip with a rearward bracket, each said rearward bracket being inserted behind the vertical section, said rearward bracket serving to cradle and support the gutter guard.

14. A gutter guard for retrofit attachment to a conventional gutter system of the type formed with a trough, said gutter guard comprising:

a unitary overhead section adjoining a vertical section, which in turn adjoins a forward section for anchoring the gutter guard to the gutter system, said vertical section being defined by a plurality of vertically-extending channels, each said vertically-extending channel positioned entirely within and running from top to bottom across a majority of said vertical section to form a vertically-oriented, narrow, elongate capillary channel, and providing ingress to the trough of said gutter system for drainage therein; and a plurality of clips securing said forward section to the existing gutter system, said clips each being formed as an angled plastic strip with a rearward bracket, each said rearward bracket being inserted behind the vertical section, said rearward bracket serving to cradle and support the gutter guard;

whereby water running down said overhead section and onto said vertical section is drawn into the channels by capillary action and is directed into said gutter system, while debris and foreign matter wash off, said gutter guard thereby preventing the gutter system from becoming clogged.

15. The gutter guard for retrofit attachment to a conventional gutter system according to claim 14, wherein said overhead section is substantially planar for insertion under the shingles on a roof, and is angled slightly downward to said vertical section.

16. The gutter guard for retrofit attachment to a conventional gutter system according to claim 14, wherein said vertical section is oriented at approximately a 90° angle when attached to said gutter system.

17. The gutter guard for retrofit attachment to a conventional gutter system according to claim 14, wherein said cavities are tightly spaced at uniform intervals along said vertical section.

18. The gutter guard for retrofit attachment to a conventional gutter system according to claim 14, wherein said forward section is a substantially horizontal flange designed for securing the gutter guard to a lip of an existing gutter system.

19. The gutter guard for retrofit attachment to a conventional gutter system according to claim 14, wherein a juncture of said overhead section and vertical section is not interrupted by said vertically-extending channels, said vertically-extending channels being framed within said vertical section.

20. The gutter guard for retrofit attachment to a conventional gutter system according to claim 14, wherein said vertically-extending channels are approximately ⅛" wide to insure proper capillary action.

21. The gutter guard for retrofit attachment to a conventional gutter system according to claim 14, wherein said vertically-extending channels create downwardly running channels along said vertical section that empty rearwardly into the existing gutter system.

22. The gutter guard for retrofit attachment to a conventional gutter system according to claim 14, wherein said forward section further comprises a pair of opposing resilient horizontal flanges for gripping a lip of the existing gutter section, thereby anchoring the gutter guard.

23. The gutter guard for retrofit attachment to a conventional gutter system according to claim 14, wherein said forward section further comprises a forwardly projecting hood for fitting down over a lip of the existing gutter section.

24. The gutter guard for retrofit attachment to a conventional gutter system according to claim 23, further comprising a plurality of screws through the hooded forward section.

25. The gutter guard for retrofit attachment to a conventional gutter system according to claim 14, wherein said gutter guard is stamped from aluminum sheet into an integral unit with punched apertures in said vertical section.

* * * * *